US005356327A

United States Patent [19]

Gill, III

[11] Patent Number: 5,356,327

[45] Date of Patent: Oct. 18, 1994

[54] WATER GRENADE BALLOON

[76] Inventor: H. Ross Gill, III, 1074 Orange Township Rd. 713, Ashland, Ohio 44805

[21] Appl. No.: 65,835

[22] Filed: May 21, 1993

[51] Int. Cl.[5] ..... A63H 27/10

[52] U.S. Cl. ..... 446/220; 249/60

[58] Field of Search ..... 446/220, 226, 225, 222, 446/223, 224; 249/60, 175

[56] References Cited

U.S. PATENT DOCUMENTS

| | | | |
|---|---|---|---|
| D. 159,718 | 8/1950 | Daniel et al. | 446/220 X |
| 718,121 | 1/1903 | Harris | 446/220 |
| 2,027,225 | 1/1936 | Gill | 446/226 |
| 2,193,069 | 3/1940 | Krueger | 446/226 |

*Primary Examiner*—Mickey Yu

*Attorney, Agent, or Firm*—J. Robert Cassidy

[57] ABSTRACT

A water grenade balloon which, when in the uninflated state, is characterized by: i) a main body having a latex sidewall having thin, outwardly projecting, intersecting longitudinal and latitudinal ribs; and ii), an integral elongate neck terminating in a rolled latex ring defining an inflation aperture. When inflated, the water grenade balloon is characterized by a smooth, uninterrupted, rounded body devoid of ribs and having darkened lines formed thereon defining discrete spaced square boxes wherein the bottom edges and the lower portions of the side edges of each box are relatively thick and prominent and the upper side and top edges are less prominent, thinner and finer, and wherein relatively thin fine darkened lines extend diagonally from each corner of each box toward diagonally adjacent boxes.

1 Claim, 8 Drawing Sheets

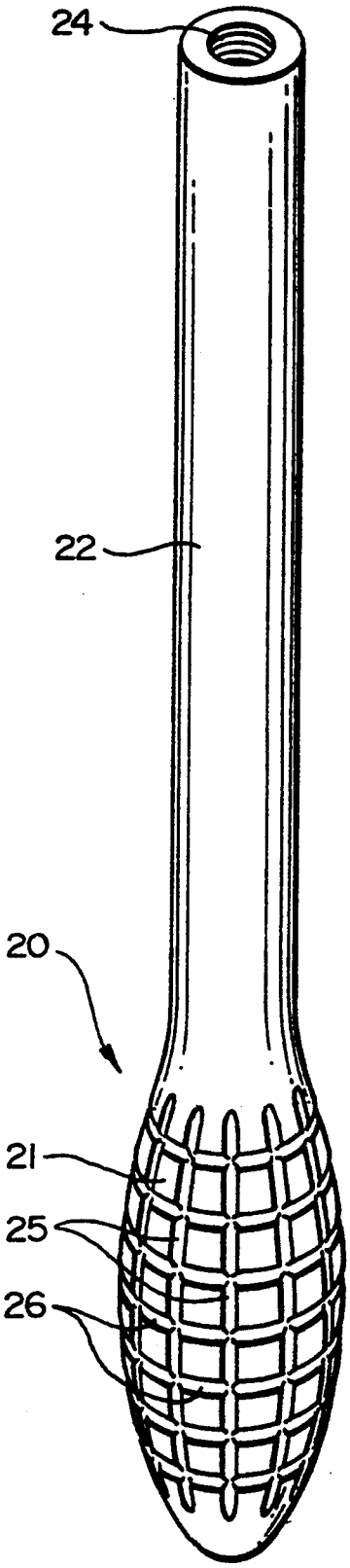
FIG. 1
PRIOR ART
FIG. 2
PRIOR ART
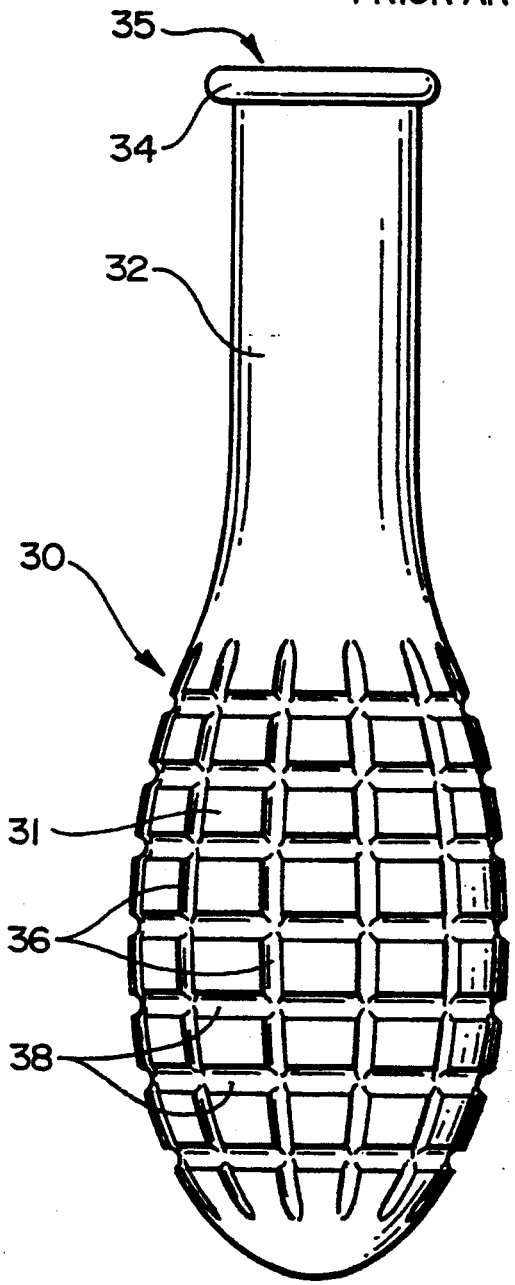

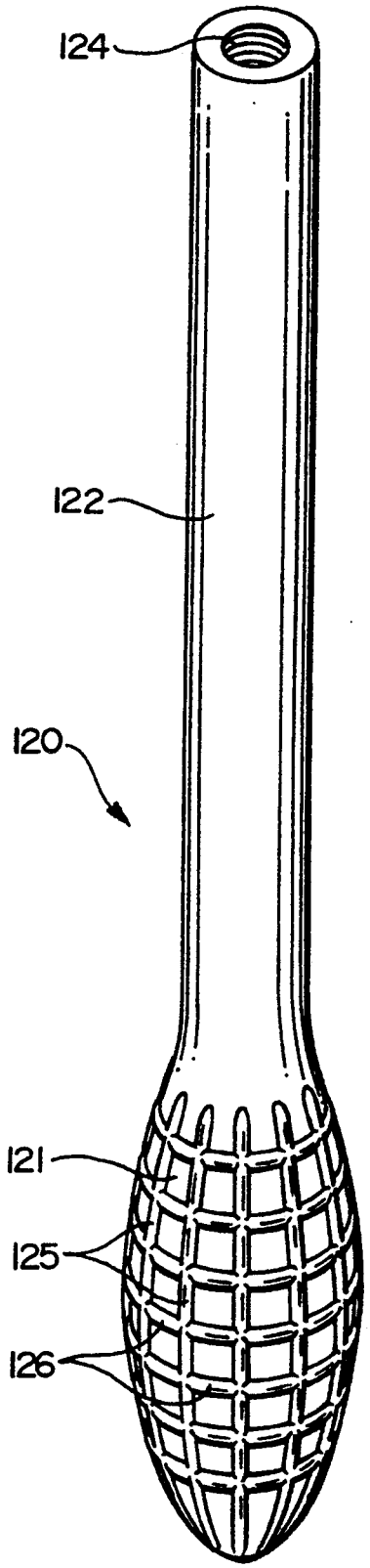
FIG. 8
FIG. 9
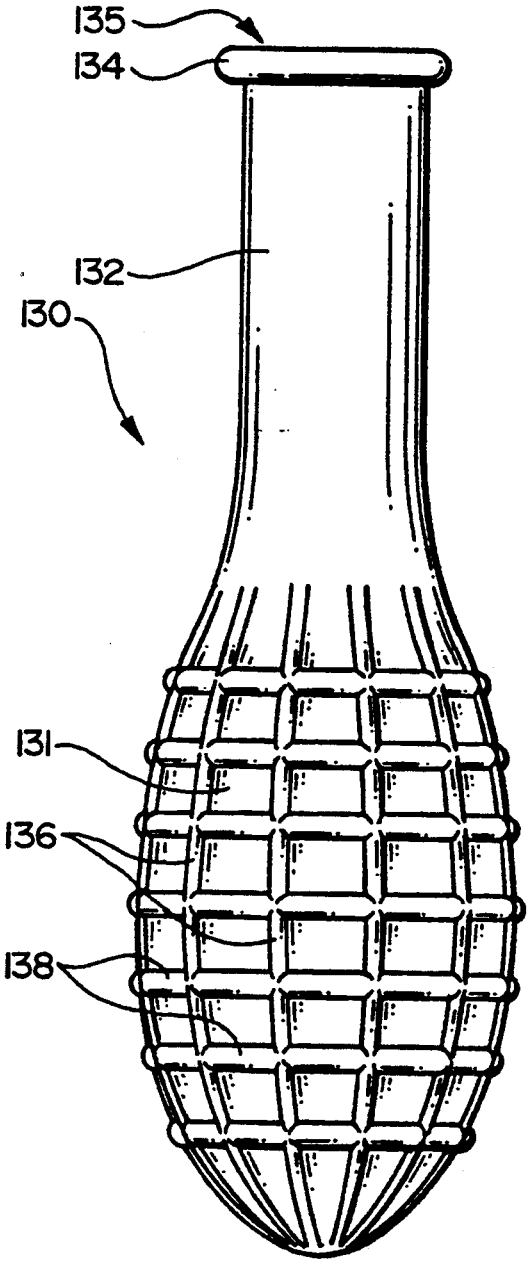

WATER GRENADE BALLOON

BACKGROUND OF THE INVENTION

1. Technical Field

The present invention relates generally to balloons; and, more particularly, to water grenade balloons and a mold for manufacturing the same.

It is to be understood as the ensuing description proceeds, that the phrase "water grenade balloon" is used herein and in the appended claims in a non-limiting descriptive sense to designate a balloon whose configuration and appearance in both the non-inflated and the inflated state—but, particularly in the non-inflated state—is intended to simulate a grenade which can advantageously be filled with water (i.e., hydraulically inflated), thus leading to its popular designation as a "water grenade balloon"; but, which can also be filled with air (i.e., pneumatically inflated) or helium (i.e., gas inflated) to produce essentially the same characteristics as any other conventional balloon. In short, while the present invention relates to what is descriptively termed a "water grenade balloon", those skilled in the art will appreciate that users of the balloon can choose to inflate it not only with water but, alternatively, with air or gas.

2. Background Art

Conventional prior art water grenade balloons have typically been formed by dipping a balloon mold into a latex bath and thereafter curing the latex and stripping the balloon from the mold. Such a prior art mold is commonly shaped with a generally elliptical surface of revolution described about its major axis; and, includes shallow, intersecting, longitudinal and latitudinal grooves so that the water grenade balloon thus formed includes shallow intersecting longitudinal and latitudinal depressed lines when the balloon is in the uninflated state to simulate the outward appearance of a grenade. Upon inflation, the balloon sidewall assumes a smooth, regular, rounded surface devoid of grooves, but having darkened intersecting longitudinal and latitudinal lines which, although not depressed, continue to simulate, albeit to a somewhat lesser extent, the appearance of a grenade.

Production lines for forming balloons vary from plant to plant and from manufacturer to manufacturer. One conventional prior technique includes, among other steps, dipping the molds into a latex bath while the molds are rotated about their vertical axes and moved laterally or horizontally through the latex bath. In such a conventional system, the mold moves vertically (both into and out of the liquid latex), horizontally and rotationally relative to the liquid latex during the dipping process; and, such a conventional process has been successfully employed to manufacture water grenade balloons using molds of the foregoing type having shallow intersecting longitudinal and latitudinal grooves formed therein. A water grenade balloon made in such a process and using such a mold is depicted in U.S. Pat. No. Des. 301,595-Murray assigned to the Assignee of the present invention.

Another conventional dipping process used in some balloon production facilities involves a latex dipping step characterized by purely vertical relative movement between the mold and the latex bath—i.e., either the molds are lowered into the latex without any relative horizontal or rotational component of motion or, alternatively, the molds are suspended in stationary form while a tank of latex is raised upwardly until the latex surrounds the stationary molds with the tank thereafter being lowered; in either case, a dipping operation devoid of any relative horizontal or rotational component of motion between the liquid latex and the mold. Unfortunately, however, it has been found that when using this conventional dipping process with molds having shallow intersecting longitudinal and latitudinal grooves, the balloons thus formed are characterized by the presence of undesirable pinholes and/or thinned weakened areas of latex which form weakened blisters when the balloon is inflated, such pinholes and weakened areas being formed on or in the linear areas of the balloon's sidewall corresponding to the longitudinal and latitudinal depressed lines formed in the balloon's sidewall when the latex is deposited in the mold's longitudinal and latitudinal grooves. The presence of one or more of such pinholes in a balloon sidewall makes it impossible to inflate the balloon, while the presence of thinned weakened regions tends to result in thin weakened blisters which burst during inflation; and, in either case, the problem renders the balloon unsalable and useless for its intended purpose.

SUMMARY OF THE INVENTION

The present invention overcomes the disadvantages inherent with usage of conventional water grenade balloon molds in latex dipping operations devoid of relative horizontal and/or rotational components of motion between the mold and the liquid latex, while at the same time providing a mold which produces a balloon characterized by its longitudinal and latitudinal lines simulating a grenade. To this end, water grenade balloon molds made in accordance with the present invention are characterized by having a main mold body configured as a generally elliptical surface of revolution described about its major axis with outwardly projecting, thin, intersecting longitudinal and latitudinal ribs as contrasted with the grooves typical of prior art water grenade balloon molds.

It has been found that when such molds are dipped into a latex bath, the balloon sidewall thus formed is devoid of pinholes and weakened areas irrespective of whether the relative motion between the mold and the liquid latex during the dipping process is purely vertical or whether it has a combination of vertical, horizontal and/or rotational components of relative motion. The balloon sidewall, in the uninflated state, is characterized by outwardly projecting, thin, intersecting longitudinal and lateral ribs (as contrasted with the grooves or depressed lines typical of the prior art); while in the inflated state, the smooth, rounded balloon sidewall exhibits darkened lines defining spaced discrete squares or boxes where the darkened lines are thicker on the side and bottom edges of each square than on the top edge, and faint diagonal lines radiate from the corners of each square towards the corners of diagonally adjacent squares.

In short, molds having thin, intersecting longitudinal and latitudinal ribs rather than grooves have been found to be capable of producing water grenade balloons which are devoid of pinholes and/or weakened or thinned wall areas irrespective of the dipping process employed. Thus, the molds of the present invention have universal utility with any of the known conventional prior art latex dipping processes employed by balloon manufacturers; and, the balloons produced thereby comprise a stylized form of water grenade balloon such as that illustrated in applicant's co-pending design application Ser. No. 07/750,025, filed Aug. 26, 1991, and assigned to the Assignee of the present invention.

DESCRIPTION OF THE DRAWINGS

These and other objectives and advantages of the present invention will become more readily apparent upon reading the following Detailed Description and upon reference to the attached drawings, in which:

FIG. 1 is an isometric view of a conventional mold used to form balloons simulating the shape and configuration of a hand grenade and having utility as a conventional water grenade balloon;

FIG. 2 is a side elevational view of a conventional water grenade balloon formed on the mold depicted in FIG. 1, here illustrating the balloon prior to inflation;

FIG. 8 is an isometric view similar to FIG. 1, here illustrating a mold embodying features of the present invention and which is suitable for manufacturing balloons simulating grenades wherein the mold is provided with outwardly projecting, thin, intersecting longitudinal and latitudinal ribs rather than incorporating longitudinal and latitudinal grooves which typify the conventional mold of FIG. 1;

FIG. 9 is a side elevational view of an uninflated water grenade balloon formed in accordance with the present invention utilizing a mold of the type depicted in FIG. 8 where such mold is employed in a conventional production line such as that shown in FIGS. 5A–5C, and here illustrating the absence of imperfections in the form of pinholes, blisters or weakened areas in the balloon sidewall; and, FIGS. 10, 11 and 12 are, respectively, side, top and bottom elevational views of the water grenade balloon shown in FIG. 9 subsequent to inflation thereof, again emphasizing the absence of imperfections in the balloon sidewall as a consequence of usage of the mold of the present invention which has been depicted in FIG. 8 in a conventional production line such as that shown in FIGS. 5A–5C.

Figure 3:
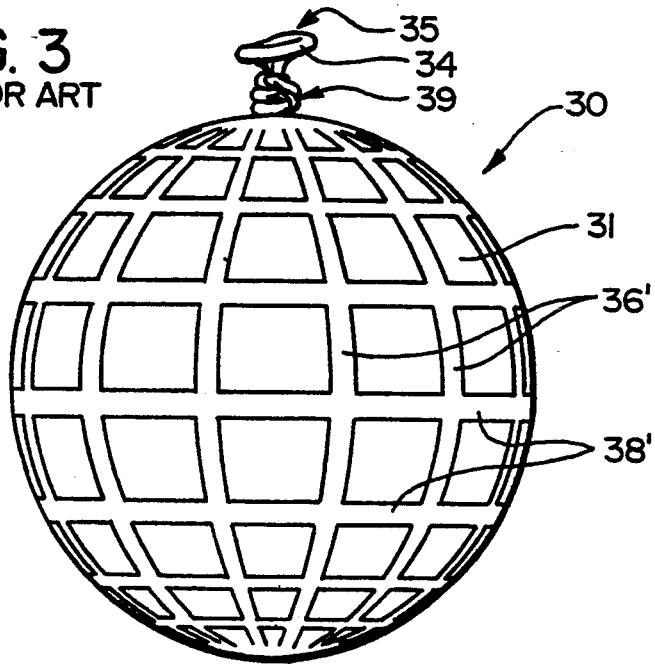
FIG. 3 PRIOR ART
FIG. 3 is a side elevational view of the conventional balloon depicted in FIG. 2 subsequent to inflation thereof.

While the invention is susceptible of various modifications and alternative forms, a specific embodiment has been shown by way of example in the drawings and will herein be described in detail. It should be understood, however, that it is not intended to limit the invention to the particular form disclosed but, on the contrary, the intention is to cover all modifications, equivalents and/or alternatives falling within the spirit and scope of the invention as expressed in the appended claims.

DETAILED DESCRIPTION

Turning now to the drawings, an exemplary conventional mold, generally indicated at 20, for forming water grenade balloons has been illustrated in FIG. 1. As will be readily noted, the mold 20 includes a main body 21 formed as a generally elliptical surface of revolution described about its major axis and terminating at its uppermost major axial extremity at the proximal end of an integral, coaxial, elongate, rod-like neck 22 having an internally threaded distal end 24 suitable for attachment to a rotatable drive mechanism forming part of a conveyor (not shown). In the illustrative prior art mold 20, the main body 21 is provided with a plurality of generally equally spaced, shallow, longitudinal grooves 25 extending between points spaced slightly from the upper and lower polar extremities of the main body 21 and intersecting with a plurality of generally equally spaced, shallow, latitudinal grooves 26.

Referring to FIG. 2, there has been illustrated a conventional water grenade balloon, generally indicated at 30, of the type produced on a conventional mold such as that shown at 20 in FIG. 1, with the balloon 30 here shown in its uninflated state. As is typical of such conventional water grenade balloons, the balloon 30 is formed of latex material having a main body or sidewall 31 and an elongate neck 32 terminating in a rolled ring 34 defining an inflation aperture, generally indicated at 35. The main body 31 or sidewall of the balloon 30 includes a plurality of generally equally spaced, shallow, longitudinal grooves 36 intersecting with a plurality of generally equally spaced, shallow, latitudinal grooves 38, thereby simulating in appearance a grenade. After the balloon 30 is inflated (either hydraulically, pneumatically or with gas) as shown in FIG. 3, the neck 32 is commonly knotted, as indicated generally at 39, or otherwise tied off to seal the balloon; and, it will be noted that in the inflated state, the balloon's latex sidewall or main body portion 31 comprises a smooth, rounded outer surface wherein the shallow longitudinal and latitudinal grooves 36, 38 depicted in FIG. 2 have disappeared and are replaced by intersecting longitudinal and latitudinal lines 36', 38' which are generally darker in appearance than the remaining portions of the balloon's sidewall 31.

When manufacturing conventional balloons—including, for example, the conventional water grenade balloon 30 shown in FIGS. 2 and 3—the process and equipment employed will generally vary from plant to plant and from manufacturer to manufacturer. Typically, however, the balloon molds—for example, a plurality of the molds 20 shown in FIG. 1—will be suspended from a moving conveyor and moved successively through a series of work stations where the molds are; i) cleaned; ii) dried; iii) dipped into a liquid coagulant; iv) dried; v) dipped into a liquid latex solution; vi) passed through a mechanism for rolling the latex deposited on the neck of the mold downwardly to form a latex ring at the balloon's inflation aperture; vii) dipped into a suitable cleaning solution to remove chemicals from the balloons; viii) passed through curing ovens where the latex is cured; and ix), passed through stripping mechanisms which serve to remove the balloons from the molds.

Figure 4:
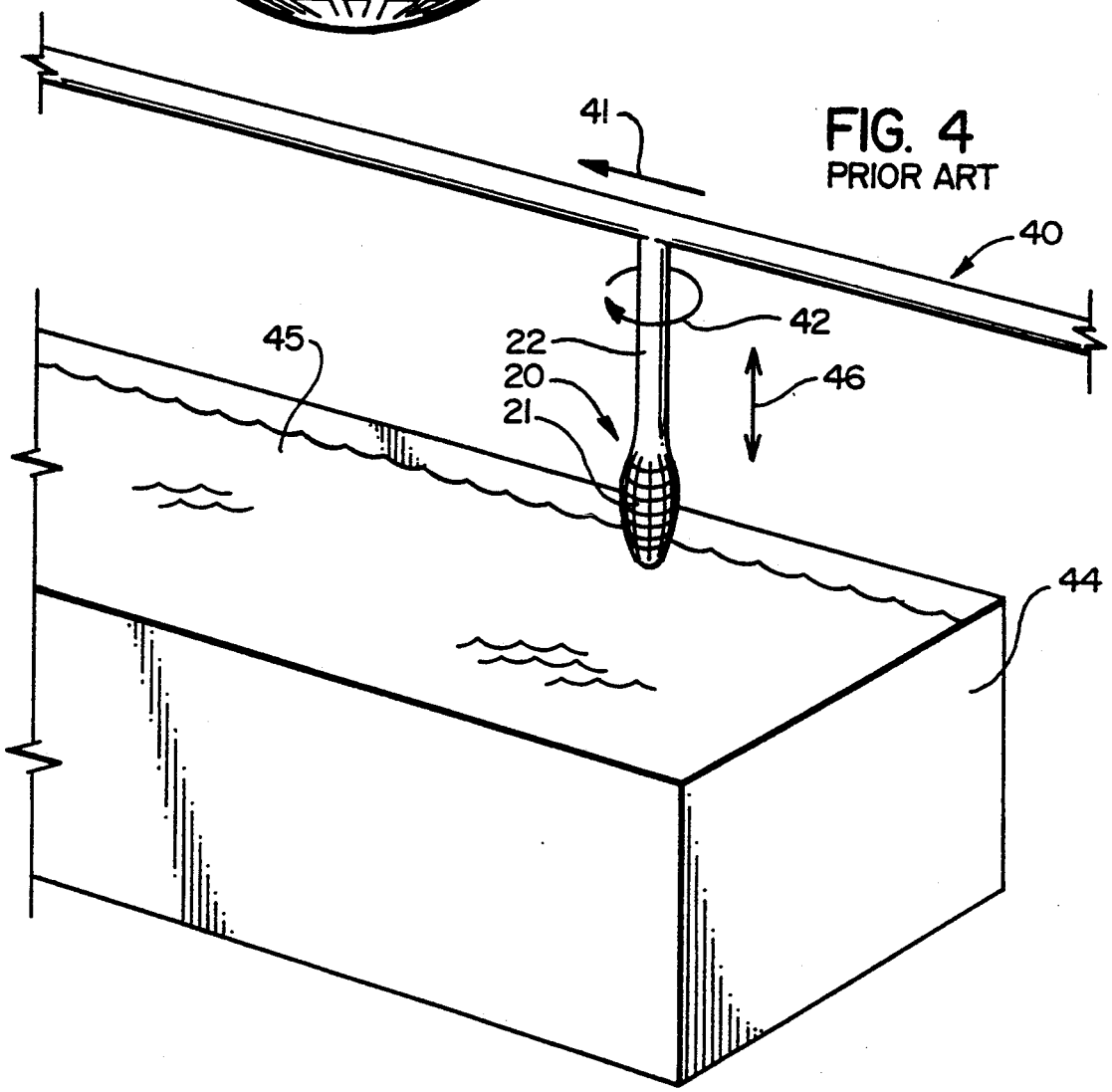
FIG. 4 PRIOR ART
FIG. 4 is a fragmentary, diagrammatic, block-and-line, isometric drawing here depicting, in highly simplified form, one conventional system for dipping balloon molds—for example, molds of the type depicted in FIG. 1—into a latex solution during a balloon manufacturing process to form latex balloons such, for example, as the conventional water grenade balloon depicted in FIGS. 2 and 3.

Referring to FIG. 4, there has been diagrammatically illustrated in highly simplified block-and-line form a typical and completely conventional dipping operation for coating the mold with liquid latex. As here shown, the molds—only one such conventional mold 20 for forming a conventional water grenade balloon 30 (FIGS. 2 and 3) is shown—are suspended from a suitable conveyor, generally indicated at 40, in any suitable manner permitting the molds to move horizontally in a lineal path as indicated by the arrow 41 while at the same time the molds 20 are rotated about their vertical axes as indicated by the arrow 42 by any suitable rotational drive means (not shown). As the molds 20 pass over a tank 44 containing liquid latex 45, the molds 20 are caused to move vertically downward relative to, and into, the liquid latex 45 as indicated by the arrow 46 with the latex completely surrounding the main body 21 of the mold 20 and extending partially up the neck 22 of the mold 20. As the mold 20 enters the liquid latex 45, it is moved vertically downward relative to the latex while simultaneously moving horizontally through the liquid latex and being driven rotationally about the mold's vertical axis; and, when the mold has been partially submerged in the liquid latex for a desired preestablished time interval, it is again moved vertically relative to the latex 45 as it is withdrawn from the latex tank 44.

Such vertical in and out motion of the mold 20 relative to the liquid latex 45 can be accomplished in a number of ways. For example, the latex tank 44 can be moved up and down to accomplish the desired introduction of the mold 20 into the liquid latex 45. Alternatively, the conveyor 40 can either be lowered or can include a dip defining a lower flight (not shown) such that as the molds 20 are moved horizontally by the conveyor, they automatically move downwardly when positioned over the tank 44 to a lower level; and, upon completion of their movement through the liquid latex 45, the conveyor 40 bends upwardly and returns to its original horizontal level so as to withdraw the molds 20 from the latex 45.

Figure 5A:
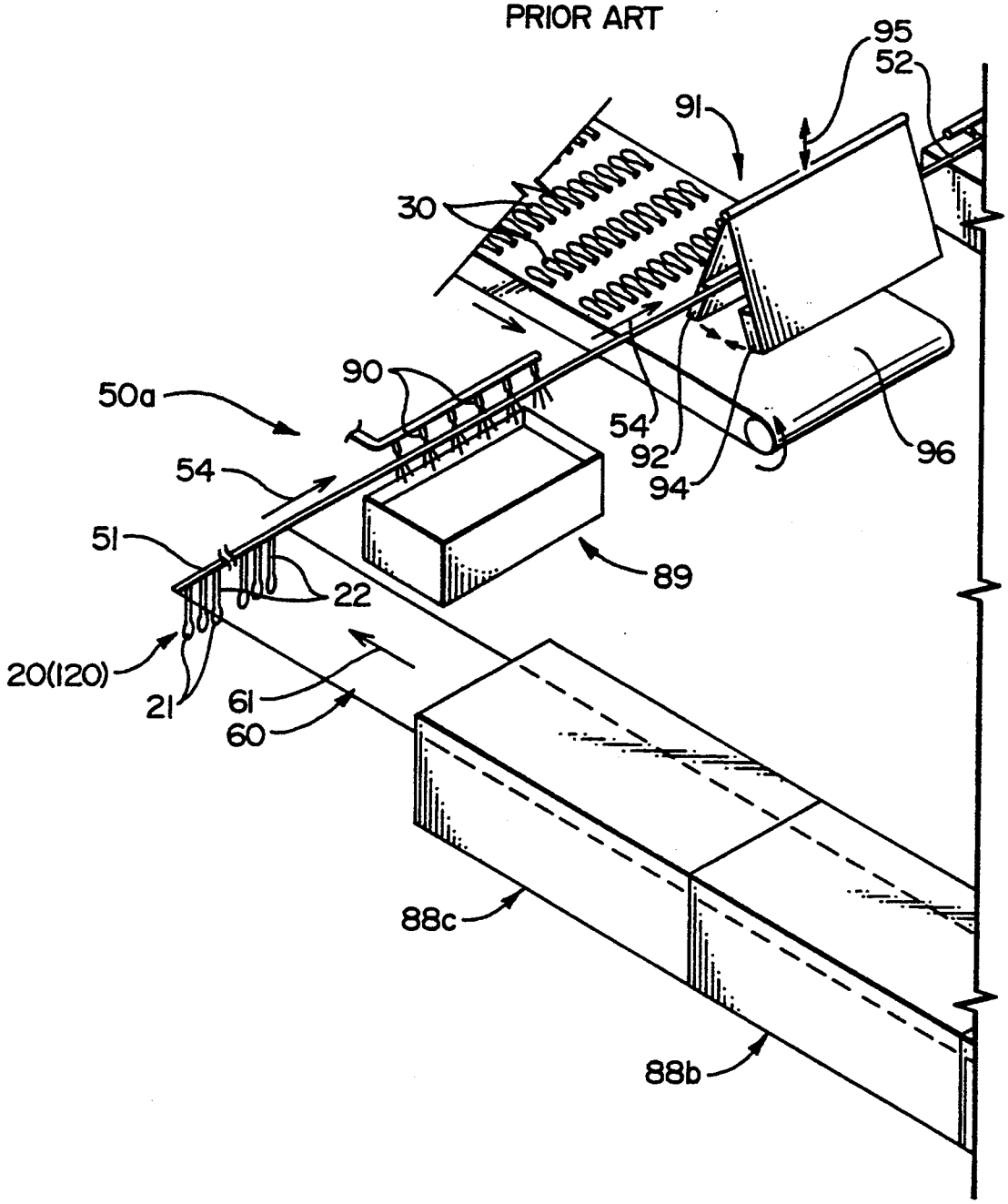
FIG. 5A PRIOR ART
FIGS. 5A through 5C, when viewed conjointly in side-by-side relation, comprise a composite, fragmentary, diagrammatic, block-and-line, isometric drawing in considerably greater detail than that shown in FIG. 4, here illustrating a conventional overall production line employing a second conventional latex dipping technique that can be used to form a wide variety of latex balloons.
Figure 5B:
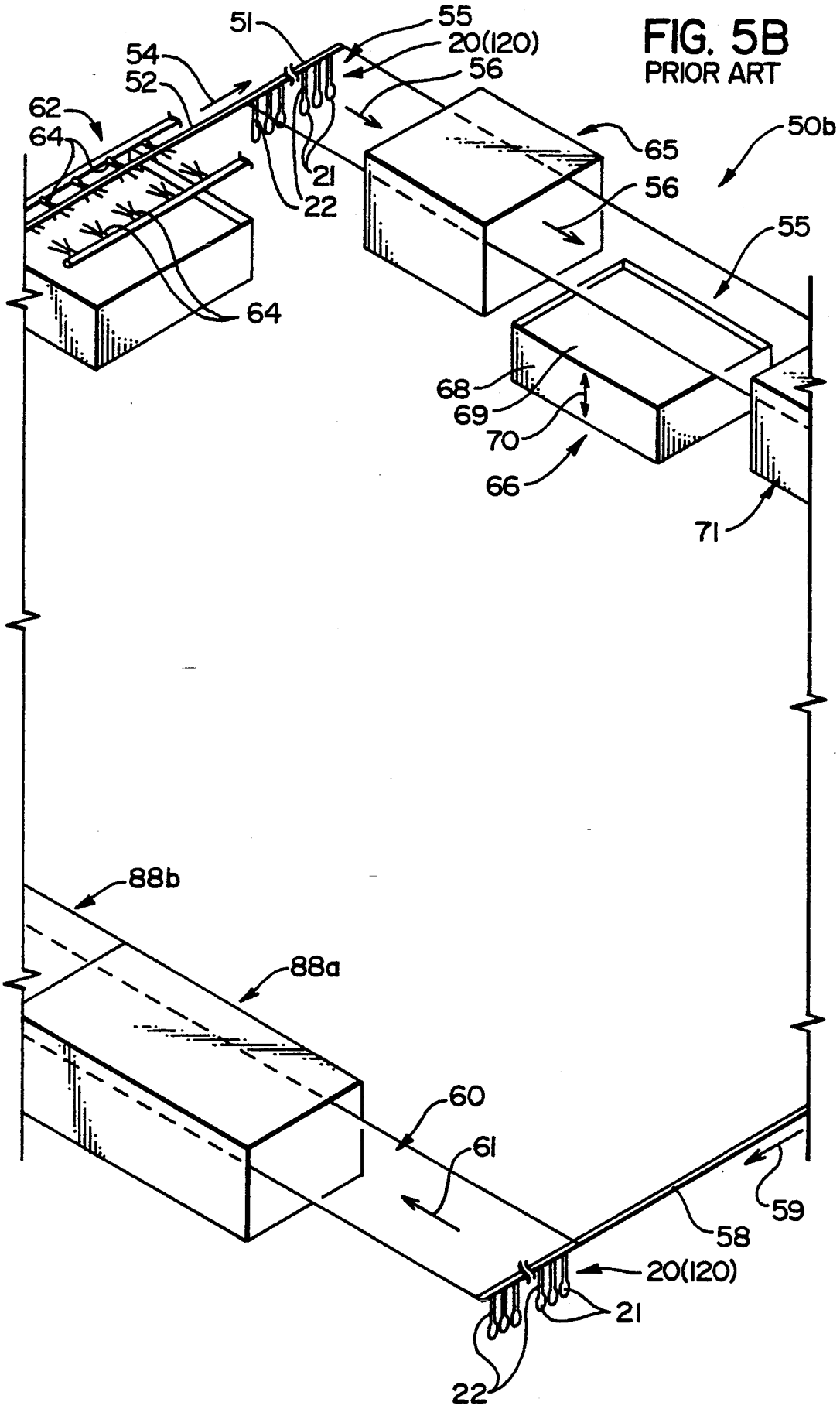
FIG. 5B PRIOR ART
Figure 5C:
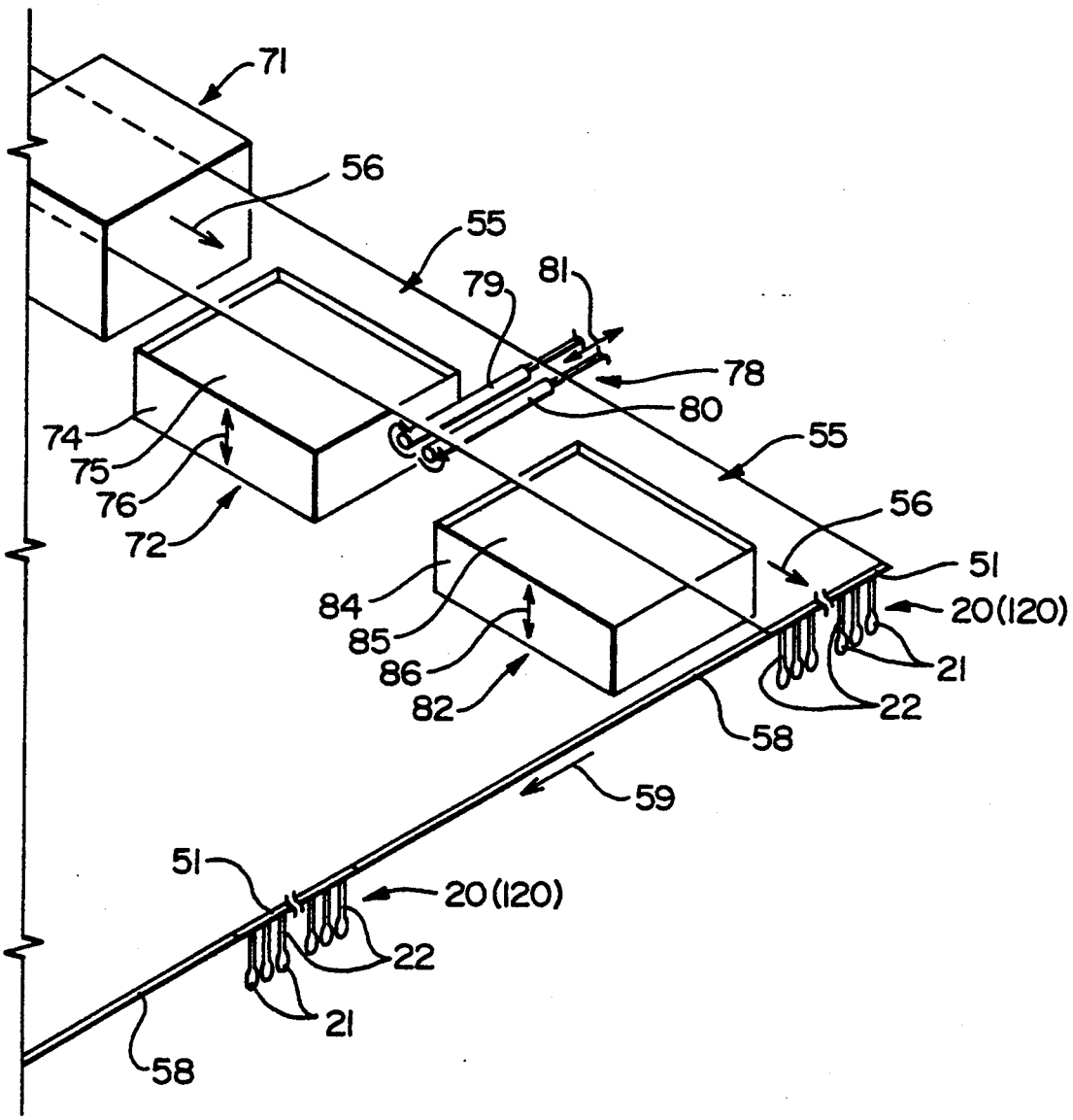
FIG. 5C PRIOR ART

Turning now to FIGS. 5A, 5B and 5C, which are laid out to be viewed conjointly in side-by-side relation, a conventional production line 50*a* (FIG. 5A), 50*b* (FIG. 5B) and 50*c* (FIG. 5C) has here been shown. In the illustrative production line 50*a*–50*c*, a plurality of balloon molds—for example, a plurality of the molds 20 depicted in FIG. 1 for forming water grenade balloons—are fixedly secured to, and suspended from, a lineal mold support strip 51 (FIG. 5B) for movement along a prescribed path through the production line 50*a*–50*c*—a path which, in FIGS. 5A–5C, comprises a rectilinear path but which can take any other desired configuration so as to make optimum use of the particular production facilities.

It will be noted upon inspection of FIGS. 5A–5C that the mold support strips 51, which are here shown in broken form, each supports a plurality of molds 20—of which only six (6) molds are visible-in depending side-by-side relation; but, in a typical conventional production line a considerably greater number of molds 20 may be suspended from each mold support strip 51. For example, from on the order of up to twenty (20) or more molds per strip to on the order of up to thirty (30) or more molds per strip may be suspended from each mold support strip 51 dependent solely upon the size of the molds, the dimensions of the conveyors employed, and the dimensions of the various ovens, baths and related process equipment used.

In the exemplary system depicted in FIGS. 5A–5C, and considering first FIG. 5B, it will be noted that the mold support strips 51 are initially moved, individually and successively, from left-to-right and from bottom-to-top via a strip conveyor 52 from the 9:00 o'clock position shown in FIG. 5A towards the 12:00 o'clock position shown in FIG. 5B—i.e., such mold support strips 51 are oriented in end-to-end relation and moved endwise through successive process stations described in greater detail below along a lineal path defined by the strip conveyor 52, all as indicated by the arrows 54.

As the individual mold support strips 51 reach the upper end of strip conveyor 52 as viewed in FIG. 5B, they are: i) delivered to a group conveyor, generally indicated at 55; ii) oriented in groups of, for example, twelve (12) mold support strips 51 per group (not shown); and iii), moved in such groups at right angles' to strip conveyor 52 along a path denoted by arrows 56—i.e., the strips 51 are moved in groups from left-to-right and top-to-bottom as viewed in FIGS. 5B and 5C from the 12:00 o'clock position (FIG. 5B) towards the 3:00 o'clock position (FIG. 5C). During such movement, the mold support strips 51 are passed in successive groups of, for example, twelve (12) parallel strips 51 per group through a series of process stations again described in greater detail below. Those skilled in the art will, of course, appreciate that where each strip 51 supports, for example, thirty (30) molds 20, and where each group contains, for example, twelve (12) strips 51, there will be a total of three hundred sixty (360) molds acted upon simultaneously in each group processing station.

Upon reaching the 3:00 o'clock position depicted in FIG. 5C, the strips 51 are again, individually and successively, moved lengthwise in end-to-end relation via a second strip conveyor 58 from the 3:00 o'clock position (FIG. 5C) towards the 6:00 o'clock position (FIG. 5B) as indicated by arrows 59.

Thereafter, the individual strips 51 are again grouped in groups of, for example, twelve (12) parallel strips 51 per group and moved via a second group conveyor 60 from the 6:00 o'clock position (FIG. 5B) to the 9:00 o'clock position (FIG. 5A) as indicated by arrows 61; and, during movement via group conveyor 60, the groups of mold strips 51 again pass through a series of process stations described in greater detail below. Finally, upon reaching the end of the path defined by group conveyor 60—i.e., the 9:00 o'clock position depicted in FIG. 5A—the individual mold support strips 51 are again moved, individually and successively, lengthwise in end-to-end relation on strip conveyor 52 along the lineal path defined by arrows 54 through a final series of process stations.

Having in mind the foregoing overall process flow, attention is now directed to the 11:00 o'clock position depicted in FIG. 5B. Thus, it will be noted that the individual mold support strips 51 being conveyed in the direction indicated by arrow 54 via strip conveyor 52 are passed through a mold cleaning station, generally indicated at 62, where the individual molds 20 suspended from each mold support strip 51 are passed through a plurality of spray heads 64 for purposes of cleaning all coagulant, chemicals, latex particles and other foreign matter from the molds 20. Thereafter, the mold support strips 51 are delivered in seritim order to a group conveyor 55; arranged in groups of, for example, twelve (12) strips per group (not shown); and, conveyed via group conveyor 55 through a drying chamber or oven, generally indicated at 65, where any moisture remaining on the molds 20 exiting from the mold cleaning station 62 is dried.

As the mold support strips 51, which are still arranged in groups of, for example, twelve (12) strips per group, exit the drying chamber 65, they pass through a coagulant application station, generally indicated at 66, where the group conveyor 55 dwells for a short period of time while a suitable liquid coagulant coating is simultaneously applied to all of the molds 20 in each group to promote subsequent adhesion of a uniform coat of liquid latex thereto. To this end, during the dwell stage of group conveyor 55, a tank 68 containing a suitable liquid coagulant 69 is moved vertically upward as indicated by arrow 70 until such time that the main body 21 of each mold in the group, and the lower end of each mold's neck 22, are immersed in the liquid coagulant 69; and, the tank 68 is then lowered as indicated by arrow 70 so as to permit continued movement of the group of mold support strips 51 along the path indicated by arrow 56 via group conveyor 55. The particular coagulant employed forms no part of the present invention; but, as those skilled in the art will appreciate, will commonly employ a mixture of calcium nitrate, talcum powder, water and a suitable surfactant or stabilizer. As each group of mold support strips 51 exits from the coagulant application station 66, it is passed through an oven, generally indicated at 71, where the liquid coagulant on the molds 20 is partially dried to a suitable tacky state.

As the group of mold support strips 51 exit the drying oven 71, group conveyor 55 carries each group of strips 51 to a latex dip station, generally indicated at 72, comprising a vertically reciprocable tank 74 containing a liquid latex solution 75. During the latex dipping cycle, group conveyor 55 dwells or remains stationary while latex tank 74 is reciprocated vertically up as indicated by arrow 76 until the coagulant coated molds 20 have their main bodies 21 and the lower portions of their necks 22 immersed in the liquid latex 75; and, after a suitable immersion period, latex tank 74 is reciprocated vertically downward as indicated by arrow 76 so as to permit resumption of movement of group conveyor 55 along the path indicated by arrow 56. It is important to note, however, that during the latex dip operation hereinabove described, the only relative movement between the molds 20 and the liquid latex 75 in tank 74 is relative vertical movement; and, there is no component of relative horizontal and/or relative rotational movement therebetween.

As the now latex coated molds 20 exit the latex dip station 72, they are passed through a ring roll station, generally indicated at 78, wherein a pair of contra-rotating opposed brush-like rollers 79, 80 are reciprocated horizontally, in the direction indicated by arrow 81, in surrounding relation to the necks 22 of all of the molds 20 suspended from each successive mold support strip 51 in each group. As the brush-type rollers 79, 80 engage the latex coating applied to the mold necks 22, the latex material is rolled downwardly along the mold's neck 22 to form a thickened rolled ring 34 of latex (FIGS. 2 and 3) adjacent, and defining the inflation aperture 35 of each balloon 30 being formed.

The groups of mold support strips 51 are, after exiting the ring roll station 78, next conveyed to a rinse or leach station, generally indicated at 82, comprising a vertically reciprocable tank 84 containing a suitable rinse or leach solution such, for example, as hot steamy water 85. As the groups of mold support strips 51 dwell over tank 84, the tank 84 is moved vertically upward as indicated by arrow 86 so as to immerse the latex coated molds 20 in the hot steamy water 85 to thereby remove any chemicals or other loose foreign particles clinging to the latex.

As the process continues, the groups of mold support strips 51 exiting the rinse/leach station 82 are conveyed by group conveyor 55 to the 3:00 o'clock position (FIG. 5C) where the individual mold support strips 51 are again shifted laterally in end-to-end relation along strip conveyor 58 in the direction indicated by the arrows 59—i.e., the mold support strips 51 are moved successively from the 3:00 o'clock position (FIG. 5C) towards the 6:00 o'clock position (FIG. 5C) where they are again arranged in groups of, for example, twelve (12) strips per group (not shown) and conveyed from right-to-left and bottom-to-top by group conveyor 60 along the path indicated by the arrows 61.

At this point in the process, the group conveyor 60 serves to transport successive groups of latex coated molds 20 suspended from the mold support strips 51 from the 6:00 o'clock position (FIG. 5B) along the path designated by arrows 61 towards the 9:00 o'clock position (FIG. 5A). As the molds 20 are moved along path 61 by group conveyor 60, they pass successively through a series of ovens, generally indicated at **88*a*, 88*b*, 88*c*** where the latex is cured to produce finished balloons.

Upon arrival at the 9:00 o'clock position (FIG. 5A), the individual mold support strips 51 are again moved laterally in end-to-end relation along strip conveyor 52 in the direction of arrows 54 from the 9:00 o'clock position (FIG. 5A) towards the starting position or the 11:00 o'clock/12:00 o'clock position (FIG. 5B), during which time the formed latex balloons 30 are stripped from the molds 20 and the molds are returned to the mold cleaning station 62 where all remaining coagulant, latex particles and/or other foreign materials are removed from the molds 20. To assist in stripping the formed and cured balloons from the molds 20, the mold support strips 51 are moved in endwise orientation through an hydraulic inflation station, generally indicated at 89, where high pressure jets 90 of water are directed axially along the necks 22 of the molds 20 into each balloon's inflation aperture so as to loosen the latex balloons thereon and begin the stripping process.

The mold support strips 51, with the partially water filled balloons on the molds 20, are then passed through a balloon stripping station, generally indicated at 91, comprising a set of vertically reciprocable scissor-operated jaws 92, 94 which, when closed, are tightly but slidably clamped about the necks 22 of the molds 20 supported by each mold support strip 51; and, as the stripping jaws 92, 94 are closed and moved downwardly as indicated by arrow 95, the jaws 92, 94 engage the rolled rings 34 at the upper ends of the partially water filled latex balloons 30 on the molds 20 and strip the balloons from the molds. The thus stripped balloons 30 are deposited on a conveyor belt 96 and conveyed to subsequent inspection and packaging stations (not shown). The molds 20 supported on the mold support strips 51 exiting the balloon stripping station 91 are then conveyed by strip conveyor 52 to, and through, the mold cleaning station 62; and, the process above described is then repeated.

Those persons skilled in the art will, of course, appreciate that the production line **50*a*–50*c* illustrated by way of example in FIGS. 5A–5C** is, for all practical purposes, diagrammatically illustrative of one of several different types of completely conventional balloon forming process lines; and, can be employed to form a wide range of different types and sizes of balloons whose characteristics are determined by the types of molds employed, the particular latex used, the colors selected for the latex bath, etc. The particular process parameters employed such, for example, as dwell times in the various baths, residence times in ovens, temperatures, makeup of the coagulant, latex and leach baths, etc., form no part of the present invention, are matters of choice proprietary to each manufacturer, and need not, therefore, be further described herein.

However, given the completely acceptable and satisfactory results heretofore achieved when forming water grenade balloons 30 (FIGS. 2 and 3) using molds 20 with shallow intersecting longitudinal and latitudinal grooves 36, 38 formed therein in a dip process such as shown in FIG. 4 where the relative motion between the molds and liquid latex comprises a combination of vertical, horizontal and the rotational components of motion as previously described, it is important to keep in mind that when water grenade balloon molds such as shown at 20 in FIG. 1 are employed in a latex dip process such as shown at 72 in FIG. 5 and described above—i.e., a process wherein the only relative motion between the molds 20 and the liquid latex 75 is relative vertical movement—completely different and totally unacceptable results have been achieved.

Figure 6:
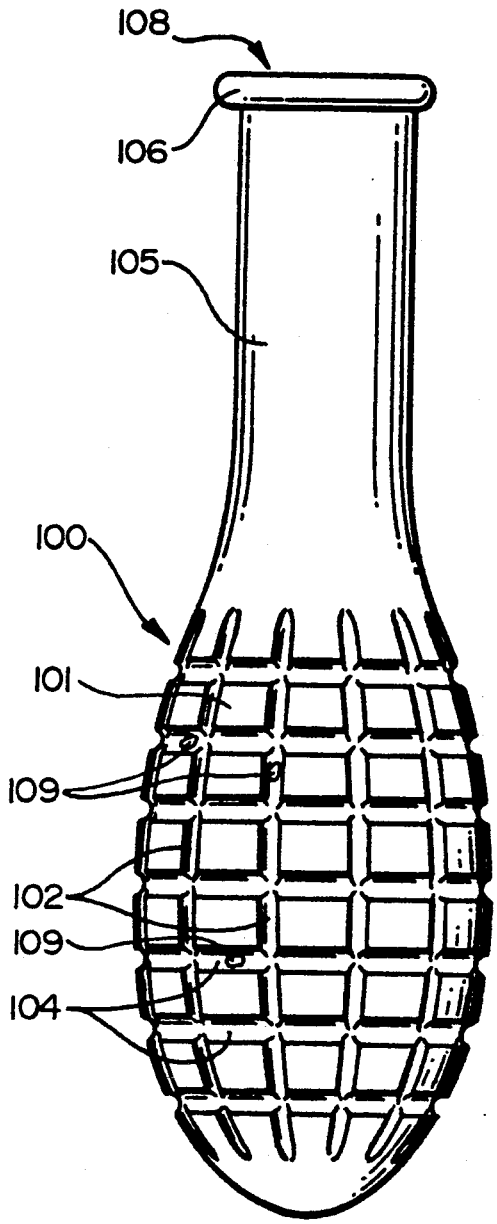
FIG. 6 is a side elevational view, similar to FIG. 2, here illustrating a latex water grenade balloon made on a mold of the type shown in FIG. 1 as used in a conventional production line of the type depicted in FIGS. 5A–5C where the only relative movement between the mold and the liquid latex is vertical movement as the mold is relatively dipped into, and removed from, the tank of liquid latex—as contrasted with the technique illustrated in FIG. 4 where the mold is simultaneously moved vertically, horizontally and rotationally relative to the liquid latex during the dipping process—and depicting particularly resulting imperfections in the form of one or more pinholes which are often produced in the balloon sidewall in the region of the shallow longitudinal and/or latitudinal grooves formed therein when using the mold of FIG. 1 in the system of FIGS. 5A–5C, and where such pinhole(s) prevent inflation of the balloon and render it useless for its intended commercial purpose.

Thus, referring to FIG. 6, an exemplary latex balloon, generally indicated at 100, has been depicted wherein the balloon 100 was formed on a mold 20 of the type shown in FIG. 1 in a production line **50*a*–50*c* of the type shown in FIGS. 5A–5C wherein the latex dip operation employed a latex dip station 72 such as shown in FIG. 5C —i.e., a latex dip operation characterized by solely vertical relative movement between the mold 20 and the liquid latex 75. As will be observed upon inspection of FIG. 6, the balloon 100 thus formed is, as anticipated, characterized by a main body 101 having shallow intersecting depressed longitudinal and latitudinal lines or grooves 102, 104 and an elongate neck 105 terminating in a rolled ring 106 surrounding the balloon's inflation aperture, generally indicated at 108. Unfortunately, however, an unacceptably high percentage of balloons 100 produced using molds 20 of the type shown in FIG. 1 in a manufacturing process employing a latex dip operation of the type employed in station 72 shown in FIG. 5C are characterized by the presence of one or more pinholes 109 which are randomly located on the balloon 100, but which are invariably contiguous with either or both of a longitudinal or latitudinal grooves 102, 104; and, such pinhole(s) 109 extend entirely through the latex sidewall of the balloon 100**, preventing inflation thereof.

Figure 7:
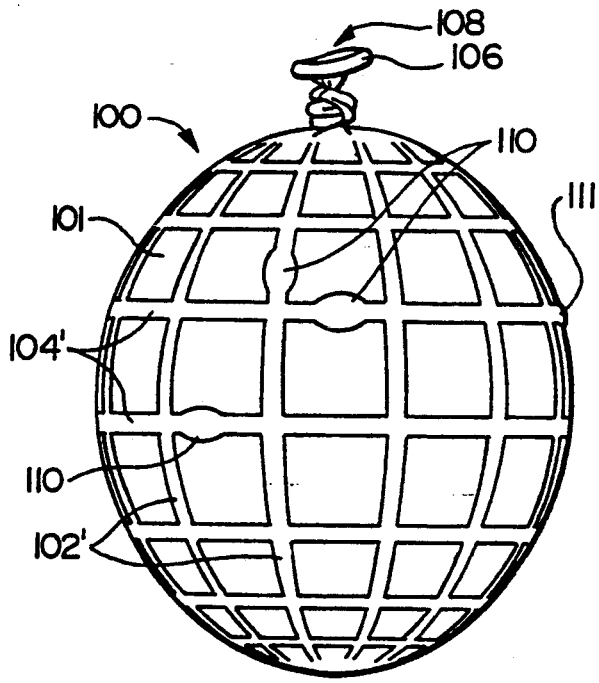
FIG. 7 is a side elevational view, somewhat similar to FIG. 3, of a partially-inflated water grenade balloon made on the conventional production line shown in FIGS. 5A–5C using the conventional mold of FIG. 1, here depicting imperfections which are commonly formed in the balloon sidewall in the form of one or more blisters or weakened areas in the regions of the longitudinal and/or latitudinal grooves in the balloon's latex sidewall where the thickness of the sidewall is insufficient to permit normal inflation of the balloon without rupture of the balloon sidewall at one of such weakened areas.

Moreover, in many instances it has been noted that even where no through pinhole(s) 109 is(are) formed, nevertheless the balloon 100 is characterized by the presence of one or more localized regions 110 where the latex sidewall formed is unacceptably thinned; and, consequently, when one attempts to inflate the balloon 100 as shown in FIG. 7, the unacceptably thinner regions 110—regions which again tend to be contiguous with the longitudinal and latitudinal grooves or darkened lines 102', 104'—expand at a much faster and greater rate than does the balance of the balloon's latex sidewall, forming one or more blisters 111 which tend to burst during inflation and thus prevent full inflation of the balloon 100.

Within either case—i.e., the presence of pinholes as indicated at 109 in FIG. 6 or thinned weakened regions 110 resulting in blisters 111 as shown in FIG. 7—an unacceptably high percentage of the balloons produced cannot be inflated and are, therefore, unsalable. Indeed, the problem has been found to be so severe that it is economically unfeasible to manufacture conventional water grenade balloons 30 (FIGS. 2 and 3) and 100 (FIGS. 6 and 7) using conventional grooved molds 20 of the type shown in FIG. 1 in a latex dip process employing purely vertical relative movement between the molds 20 and liquid latex 75 during the dipping operation as shown in latex dip station 72 in FIG. 5C.

In accordance with one of the important aspects of the present invention, a mold, generally indicated at 120 in FIG. 8, is provided which is capable of producing stylized water grenade balloons which are, in virtually every instance, devoid of through pinholes, weakened areas, and/or blisters irrespective of the type of latex dipping operation employed, yet which simulate in appearance, especially prior to inflation, a grenade. To accomplish this, the illustrative mold 120 depicted in FIG. 8 includes a main body 121 formed as a generally elliptical surface of revolution described about its major axis and terminating at its upper major axial extremity at the proximal end of an integral, coaxial, elongate, rod-like neck 122 having an internally threaded distal end 124 suitable for attachment to a mold support strip such as that shown at 51 in FIGS. 5A–5C or to any other desired type of conveyorized mold support. In the exemplary mold embodying features of the present invention as depicted at 120 in FIG. 8, the main body 121 is provided with a plurality of generally equally spaced, thin, outwardly projecting, longitudinal ribs 125 extending between points spaced slightly from the upper and lower polar extremities of the main body 121 and intersecting with a plurality of generally equally spaced, thin, outwardly projecting latitudinal ribs 126. Thus, a mold 120 embodying features of the present invention suitable for manufacturing water grenade balloons is characterized by the presence of thin, outwardly projecting, intersecting longitudinal and latitudinal ribs 125, 126 as contrasted with the shallow, inwardly projecting, intersecting longitudinal and latitudinal grooves 25, 26 which characterize the conventional prior art water grenade balloon mold 20 depicted in FIG. 1.

In keeping with the present invention, a plurality of molds 120 of the type depicted in FIG. 8 and as hereinabove described were secured to mold support strips 51 and utilized in the conventional production line 50*a*–illustrated in FIGS. 5A–5C in lieu of the molds 20 50*c* (FIG. 1) as previously described. That is to say, the molds 120 were cleaned in mold cleaning station 62 (FIG. 5B), passed through drying chamber 65, coated with a coagulant in coagulant application station 66, dried to a tacky state in drying oven 71 (FIG. 5C), and then coated with liquid latex 75 in latex dip station 72 where the relative motion between the molds 120 and the liquid latex 75 was purely vertical as the latex tank 74 was raised relative to the molds 120 while the group conveyor 55 was in a dwell state to immerse the molds 120 and the lower ends of their necks 122 in the liquid latex. After a suitable dwell period within the liquid latex, the tank 74 was lowered relative to the molds 120 so as to withdraw the molds, now suitably coated with latex, from the tank; and, the process previously described was continued by forming the rolled rings defining the balloons' inflation apertures in the ring rolling station 78, cleaning the thus formed balloon in rinse/-leach station 82 (FIG. 5C), curing the balloons in curing oven stages 88*a*, 88*b*, 88*c* (FIGS. 5B and 5A), and stripping the water grenade balloons thus formed from the molds 120 in the hydraulic inflation station 89 and the balloon stripping station 91 (FIG. 5A), with the molds 120 then being returned to the mold cleaning station 62 (FIG. 5B).

Whereas water grenade balloons 100 (FIGS. 6 and 7) manufactured using the production line 50*a*–50*c* depicted in FIGS. 5A–5C in conjunction with the conventional molds 20 of FIG. 1 were defective because of the presence of one or more pinholes 109 (FIG. 6), weakened regions 110 and/or blisters 111 (FIG. 7), when using the molds 120 (FIG. 8) of the present invention in that very same production line 50*a*–50*c* (FIG. 5A–5C), it was noted that the water grenade balloons thus formed were, in virtually every instance, devoid of pinholes, weakened areas and/or blisters and, additionally, were characterized by a unique appearance simulating a grenade when uninflated and a completely different and distinctive stylized and aesthetically pleasing appearance when inflated. In short, the water grenade balloons thus formed were devoid of the defective characteristics of the balloons 120 shown in FIGS. 6 and 7 and were completely acceptable for commercial sale and usage.

Thus, referring to FIG. 9, it will be observed that the exemplary water grenade balloon, generally indicated at 130, formed in a production line 50*a*–50*c* such as that shown in FIGS. 5A–5C and using the molds 120 of FIG. 8, is characterized by a somewhat elliptical main latex body or sidewall 131 terminating at its upper major axial extremity in an elongate neck 132 having a rolled latex ring 134 defining the balloon's inflation aperture, generally indicated at 135. The balloon 130 is, when in the uninflated state as shown in FIG. 9, further characterized by the presence of thin, outwardly projecting, generally equally spaced, longitudinal ribs 136 intersecting with thin, outwardly projecting, generally equally spaced, latitudinal ribs 138, thereby simulating a grenade.

Figure 10:
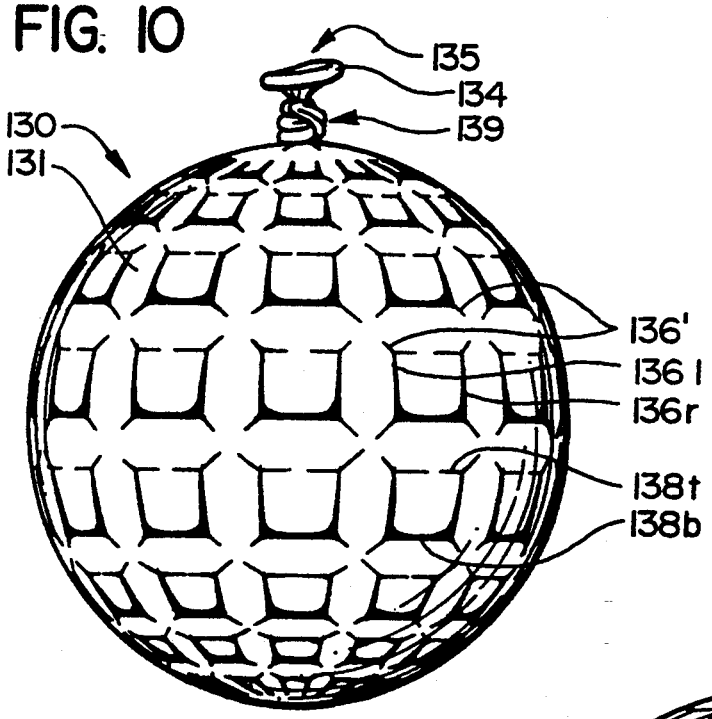
Figure 11:
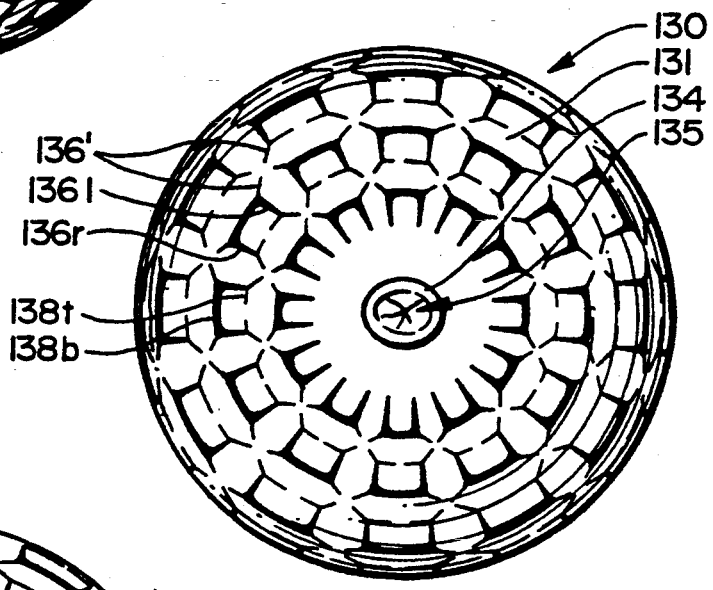
Figure 12:
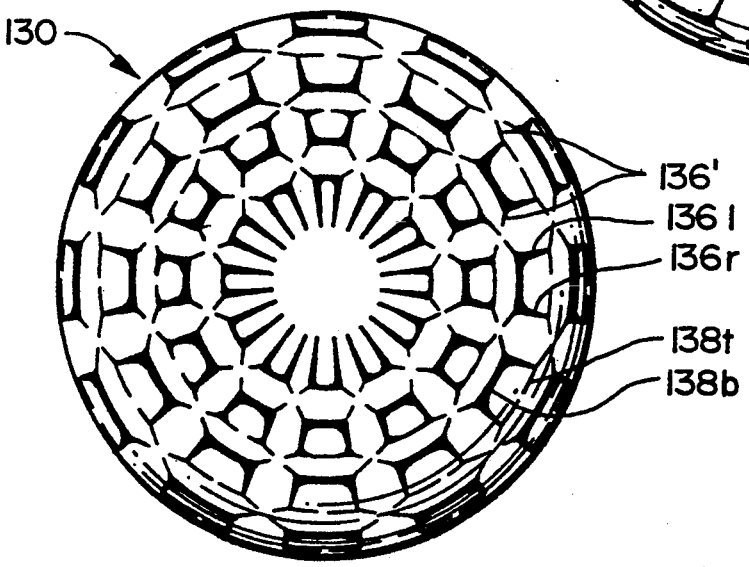

However, when inflated and sealed by tying off and/or knotting the balloon neck 132 as generally indicated at 139 in FIG. 10, the balloon 130 made in accordance with the present invention exhibits a completely unique and aesthetically pleasing outward appearance as best observed by inspection of FIGS. 10–12 conjointly. Thus, it will be noted that when inflated, the balloon 130 of FIG. 9 again exhibits a smooth, generally rounded sidewall 131 totally devoid of outwardly projecting ribs. However, in place of the longitudinal and latitudinal ribs 136, 138 (FIG. 9) which were present prior to inflation following inflation, the balloon 130 was characterized by essentially discontinuous darkened lines defining spaced, discrete, relatively square boxes each having: i) relatively thick and prominent bottom edges 138*b*; ii) left and right side edges 136*l*, 136*r*, which are relatively thick and prominent at the lowermost ends thereof, but which become thinner and finer towards their upper ends; iii) relatively thin, fine top edges 138*t*; and iv), thin, fine lines 136' flaring-diagonally outward from each corner of the boxes thus described and extending towards diagonally adjacent boxes. Thus, the overall effect simulates a stylized form of grenade.

Those skilled in the art will appreciate from the foregoing description taken in conjunction with the accompanying drawings that water grenade balloon molds 120 (FIG. 8) embodying features of the present invention and characterized by thin, outwardly projecting, intersecting longitudinal and latitudinal ribs 125, 126 as contrasted with the inwardly projecting shallow grooves 25, 26 (FIG. 1) which typify the prior art molds 20, have proven suitable for manufacturing water grenade balloons 130 (FIGS. 9–12) using simple conventional latex dipping procedures devoid of relative horizontal and/or relative rotational components of motion between the mold 120 and the liquid latex, yet wherein the resulting balloons 130 are not only devoid of pinholes, weakened sidewall regions and/or blisters, but, which are characterized by an appearance simulating a grenade when uninflated, and a unique, highly stylized, and aesthetically pleasing appearance when inflated.

It will, of course, be understood that while the present invention has been described in connection with a mold 120 (FIG. 8) having a main body 121 configured generally as an elliptical surface of revolution described about a major axis, the invention is not limited to molds having that specific shape; but, rather, can be employed with molds having other regular or irregular configurations—i.e., rounded or oblate, flatted, etc.—provided only that the outer surface of the mold's main body is formed with thin, outwardly projecting intersecting ribs rather than inwardly projecting intersecting grooves.

I claim:

1. A balloon comprising:

a) an inflatable latex sidewall terminating at one end in an integral neck having an integral rolled latex ring at its distal end surrounding said neck and defining an inflation aperture;

b) said latex sidewall, when in the uninflated state, being characterized by:

(i) a plurality of thin, outwardly projecting, longitudinal ribs; and, (ii) a plurality of thin, outwardly projecting, latitudinal ribs intersecting said longitudinal ribs; and, c) said latex sidewall, when in the inflated state, being characterized by a smooth, uninterrupted, rounded surface devoid of outwardly projecting ribs and having a plurality of darkened lines formed thereon, said lines defining a plurality of discrete spaced boxes each having:

(i) relatively thick and prominent bottom edges;

(ii) left and right side edges which are relatively thick and prominent at their lower ends and which gradually decrease in prominence and thickness at their upper ends forming relatively fine lines;

(iii) a top edge comprising a relatively thin fine line; and, (iv) a fine line extending diagonally from each corner of each box toward diagonally adjacent ones of said spaced discrete boxes.

* * * * *